US005947190A

United States Patent [19]

Murase et al.

[11] Patent Number: 5,947,190

[45] Date of Patent: Sep. 7, 1999

[54] HEATER CORE MOUNTING STRUCTURE

[75] Inventors: Masayuki Murase; Yutaka Shichiken, both of Saitama Prefecture, Japan

[73] Assignee: Zexel Corporation, Japan

[21] Appl. No.: 08/972,621

[22] Filed: Nov. 18, 1997

[30] Foreign Application Priority Data

Nov. 22, 1996 [JP] Japan ..... 8-325861

[51] Int. Cl.[6] ..... F28F 9/013

[52] U.S. Cl. ..... 165/67; 165/78; 165/149; 165/153

[58] Field of Search ..... 165/67, 78, 149, 165/153, 176

[56] References Cited

U.S. PATENT DOCUMENTS

| | | | |
|---|---|---|---|
| 4,328,859 | 5/1982 | Bouvot | 165/78 |
| 4,723,601 | 2/1988 | Ohara et al. | 165/153 |
| 5,318,114 | 6/1994 | Sasaki | 165/176 |

FOREIGN PATENT DOCUMENTS

| | | | |
|---|---|---|---|
| 2855285 | 7/1980 | Germany | 165/153 |
| 55547 | 4/1976 | Japan . | |
| 99107 | 7/1983 | Japan . | |
| 133306 | 9/1984 | Japan . | |
| 89668 | 6/1986 | Japan . | |
| 122107 | 8/1986 | Japan . | |
| 96205 | 7/1990 | Japan . | |

*Primary Examiner*—Leonard Leo
*Attorney, Agent, or Firm*—Ostrolenk, Faber, Gerb & Soffen, LLP

[57] ABSTRACT

A heater core mounting structure 20 for mounting any one of multiple stacked-plate heater cores 3A of different thickness in a heater case 2 without modification of the heater case 2 comprises a spacer 21 provided with engagement portions 26 configured to engage end portions 5A of the heater core 3A. The heating core mounting structure 20 enables mounting of different sized heater cores 3A at low cost, prevents shift of the stacked plates 5 during mounting, and protects the stacked end portions 5A.

13 Claims, 5 Drawing Sheets

HEATER CORE MOUNTING STRUCTURE

BACKGROUND OF THE INVENTION

1. Field of the Invention

This invention relates to a heater core mounting structure, more particularly to a heater core mounting structure for mounting a stacked-plate heater core in a heater case when assembling a heater unit.

2. Background Art

A conventional heater core mounting structure will be briefly explained with reference to FIG. 6.

FIG. 6 is a side sectional view of a heater unit 1. The heater unit 1 has a heater case 2, a heater core 3 and linings 4 made of urethane resin or the like to serve as mounting members.

The heater core 3 has multiple stacked plates 5 whose main surfaces are formed by aluminum brazing or the like with ridges and valleys for forming passages. The plates 5 are stacked in the direction perpendicular to the drawing sheet to establish heat exchange medium passages between adjacent plates 5. A tank 6 is provided at one end of the stacked plates 5. Stacked end portions 5A of the stacked plates 5 project at positions on the opposite side from the tank 6.

The tank 6 is connected with an inlet pipe 7 and an outlet pipe 8 for the heat exchange medium.

The linings 4 serving as mounting members between the tank 6 and the heater case 2 and between the end portions 5A and the heater case 2 absorb vibration and provide thermal insulation. The linings 4 in combination constitute a mounting structure 9 for mounting the heater core 3 in the heater case 2.

Different heater units 1 may, however, be used in different environments and seasons that require installation of heater cores 3 of different thicknesses. In this case, one of multiple (e.g., two) types of heater cores 3 is selected for mounting in each heater case 2.

When a heater core 3 of a different thickness becomes necessary, a choice has had to be made among fabricating a new type of heater case 2, modifying the existing heater case 2, and fabricating the heater core 3 that should rightly be of different thickness to the same thickness T as the heater core 3 of greater thickness. All three alternatives lead to a great increase in cost.

One conceivable way to avoid this problem is by manufacturing the heater case 2 in conformity with the thicker heater core 3 and fitting the thinner heater core 3 with spacers (not shown) that enable it to be mounted as if it had the same thickness as the thicker heater core 3. This would minimize cost increase because it does not require modification of the heater case 2 or the shape of the thinner heater core 3.

It has so far not been a satisfactory solution, however, because the positioning of the spacers for mounting on the heater core 3 has been difficult. Specifically, a shift has tended to occur in the stacked direction of the plates 5 when the spacers are mounted on the heater core 3.

In the case of the heater core 3 of stacked structure, moreover, the end portions 5A of the stacked plates 5 are present as a large number of thin projections sticking out slightly from the main bodies of the stacked plates 5 and are therefore easily damaged during handling.

FIG. 7 shows a conventional arrangement in which a cooler unit (evaporator 10) and an air-mixing door 11 are disposed on the upstream side of a heater core 3, an associated bypass 12 is established and an air-mixing chamber 13 is formed on the downstream side so that warm and cold air can be mixed at an appropriate ratio in the air-mixing chamber 13.

With this arrangement, any change in the thickness of the heater core 3 changes the volume of the air-mixing chamber 13, which may in turn alter the air-mixing performance. An attempt to reestablish or maintain the air-mixing performance by design changes or adjustments inevitably requires alterations to the entire housing.

Heater core mounting structures are taught by, for example, Japanese Utility Model Disclosures Sho 51-55547, Sho 58-99107, Sho 59-133306 Sho 61-89668, Sho 61-122107 and Hei 2-96205.

This invention was accomplished in light of the foregoing problems and has as one of its objects to provide a heater core mounting structure enabling heater cores of different thickness to be mounted in the same heater case.

Another object of the invention is to provide a heater core mounting structure enabling heater cores of different thickness to be mounted in the same heater case with minimal cost increase.

Another object of the invention is to provide a heater core mounting structure capable of preventing shift of the stacked plates of the heater core when spacers are mounted on the heater core.

Another object of the invention is to provide a heater core mounting structure capable of protecting the end portions of the stacked plates when a stacked-plate heater core is mounted in a heater case.

Another object of the invention is to provide a heater core mounting structure that enables the volume of an air-mixing chamber to be maintained or varied independently of the thickness of the heater core, thereby facilitating the maintenance and/or adjustment of air-mixing performance.

SUMMARY OF THE INVENTION

This invention is directed to a heater core mounting structure in which a spacer is provided with engagement portions for engagement with the end portions of the stacked plates. Specifically, it realizes the aforesaid objects by providing a heater core mounting structure for mounting a stacked-plate heater core in the heater case of a heater unit, the heater core mounting structure comprising a spacer by which the heater core is mounted in the heater case, the spacer being of greater width than the heater core and being provided with engagement portions configured to engage the stacked end portions of the heater core.

In a preferred aspect of the invention, the ease and sturdiness of the engagement between the engagement portions of the spacer and the end portions of the stacked plates of the heater core is enhanced by forming the engagement portions as multiple slits.

In another preferred aspect of the invention, the spacer is provided with main fixing portions disposed to face each other in the direction of heater core thickness, auxiliary fixing portions disposed to face each other in the stacked direction of the heater core and a floor portion enclosed by the main fixing portions and the auxiliary fixing portions, and the engagement portions are provided in the floor portion. Since the auxiliary fixing portions prevent the heater core from shifting in its stacked direction, the heater core can be sturdily mounted with respect to the spacer.

Since the heater core mounting structure according the present invention is provided in the spacer with the engagement portions, e.g., slits, configured to engage the end portions of the stacked plates, the part of the heater core that is most easily damaged and/or deformed can be protected while simultaneously enabling a heater core of different thickness (a thinner heater core) to be mounted in the heater case via the spacer.

This means that only one size of heater case of a thickness conforming with the thickness of the thickest heater core has to be manufactured, because thinner heater cores can be mounted in this fixed sized heater case by use of the spacer. Cost increase is therefore minimal.

Forming the engagement portions as slits increases the efficiency of the mounting work since it simplifies heater core positioning by preventing shift of the stacked plates in their stacked direction.

Use of slits also has the advantage of permitting observation of the engagement state of the end portions of the stacked plates from the underside of the spacer. This eliminates concern about whether the stacked end portions are properly engage.

In another preferred aspect of the invention, the heater core mounting structure is adapted for use in a configuration in which an air-mixing chamber is formed on the downstream side of the heater core. This is achieved by enabling the relative position between the spacer and the heater core engaged therewith to be adjusted in the direction of air flow. Specifically, the mounting position of the heater core is made adjustable in the upstream and downstream directions relative to the center line of the spacer fixed at a prescribed location. By this, in the case of mounting a thin heater core, for example, its position can be regulated to adjust the volume of the air-mixing chamber to maintain the same air-mixing performance as when a thicker heater core is installed.

DETAILED DESCRIPTION OF THE PREFERRED EMBODIMENTS

Figure 6:
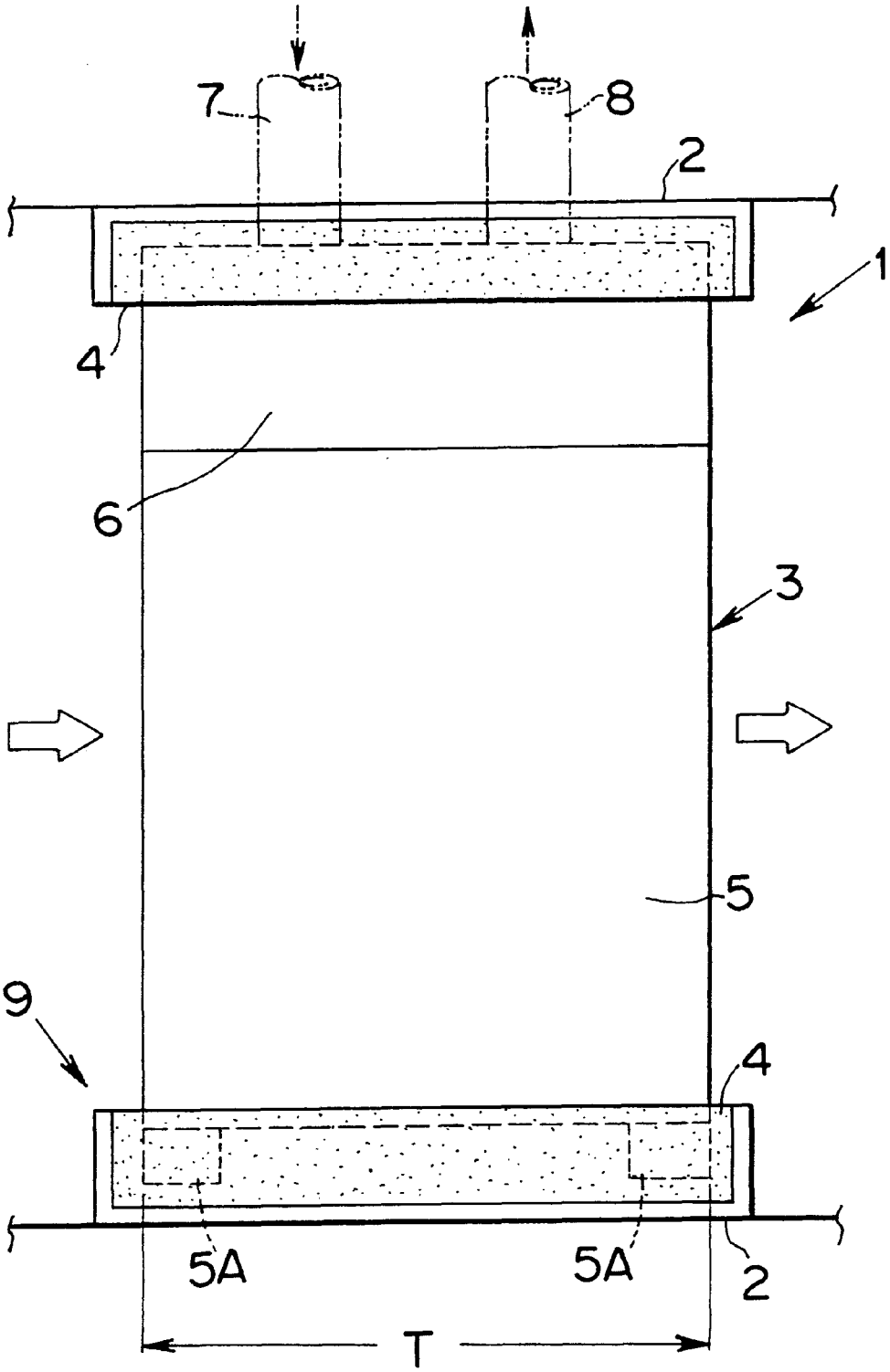
Fig. 6 Prior Art
FIG. 6 is a side sectional view of a heater unit 1 for explaining a conventional mounting structure 9 for a heater core 3.
Figure 7:
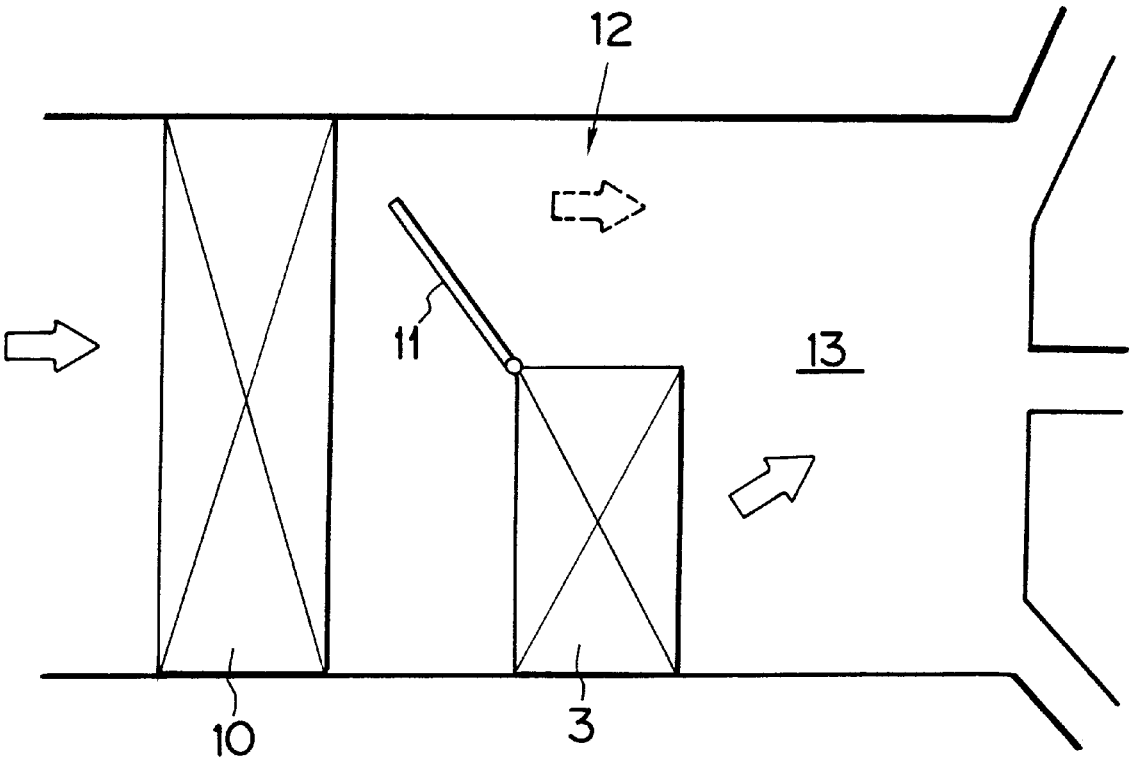
Fig. 7 Prior Art
FIG. 7 is a schematic side view showing a conventional arrangement in which an air-mixing chamber 13 is formed on the downstream side of the heater core 3.

A heating core mounting structure 20 that is a first embodiment of the invention will now be explained with reference to FIGS. 1 to 3. Members like those in FIG. 6 are assigned like symbols to those in FIGS. 6 and will not be explained again here.

In the following explanation, the heater core mounted in the heater case 2 by use of the heating core mounting structure 20 is a heater core 3A of smaller thickness than the heater core 3 shown in FIG. 6.

Figure 1:
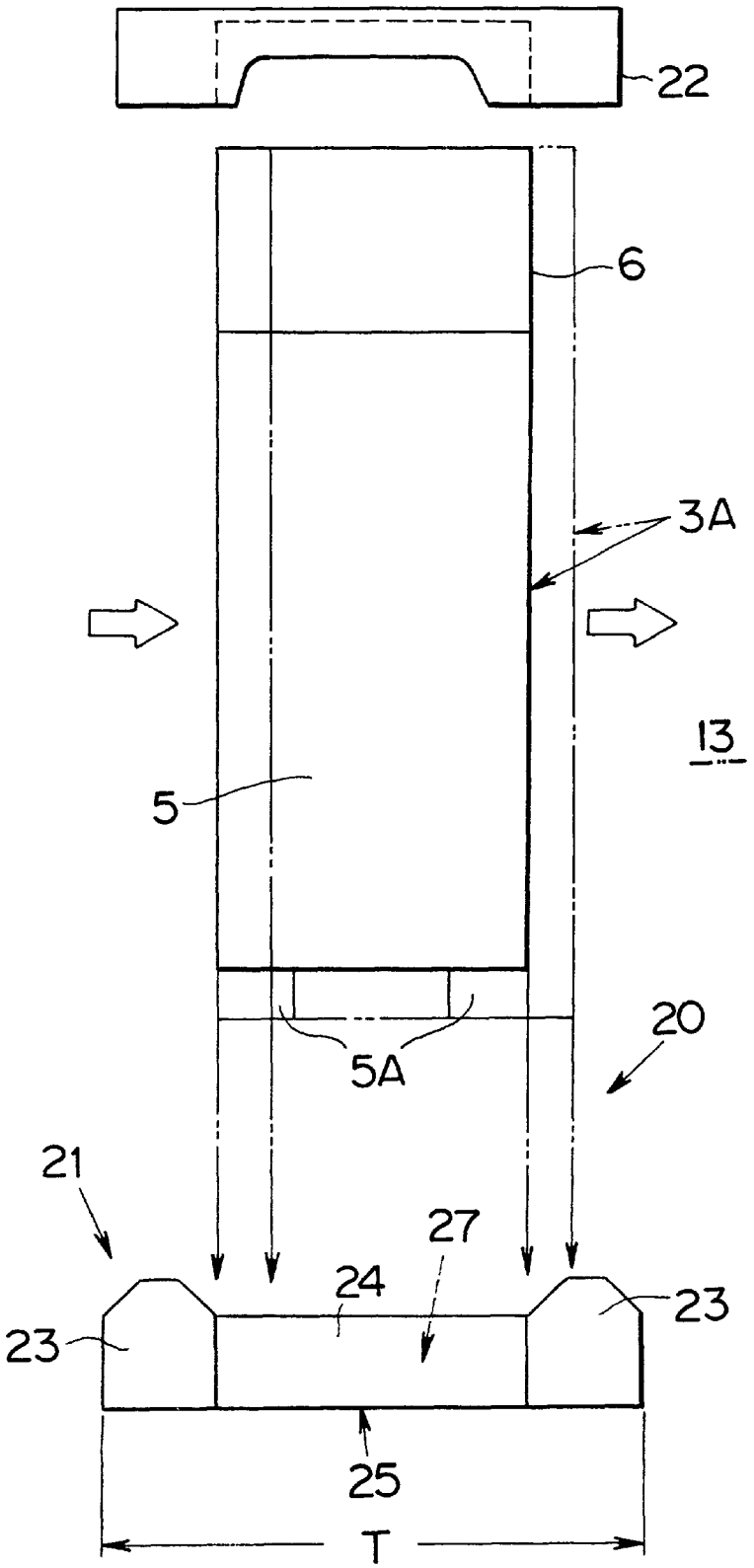
FIG. 1 is a side view of a mounting structure 20 for a heater core 3A, which is a first embodiment of the invention.
Figure 2:
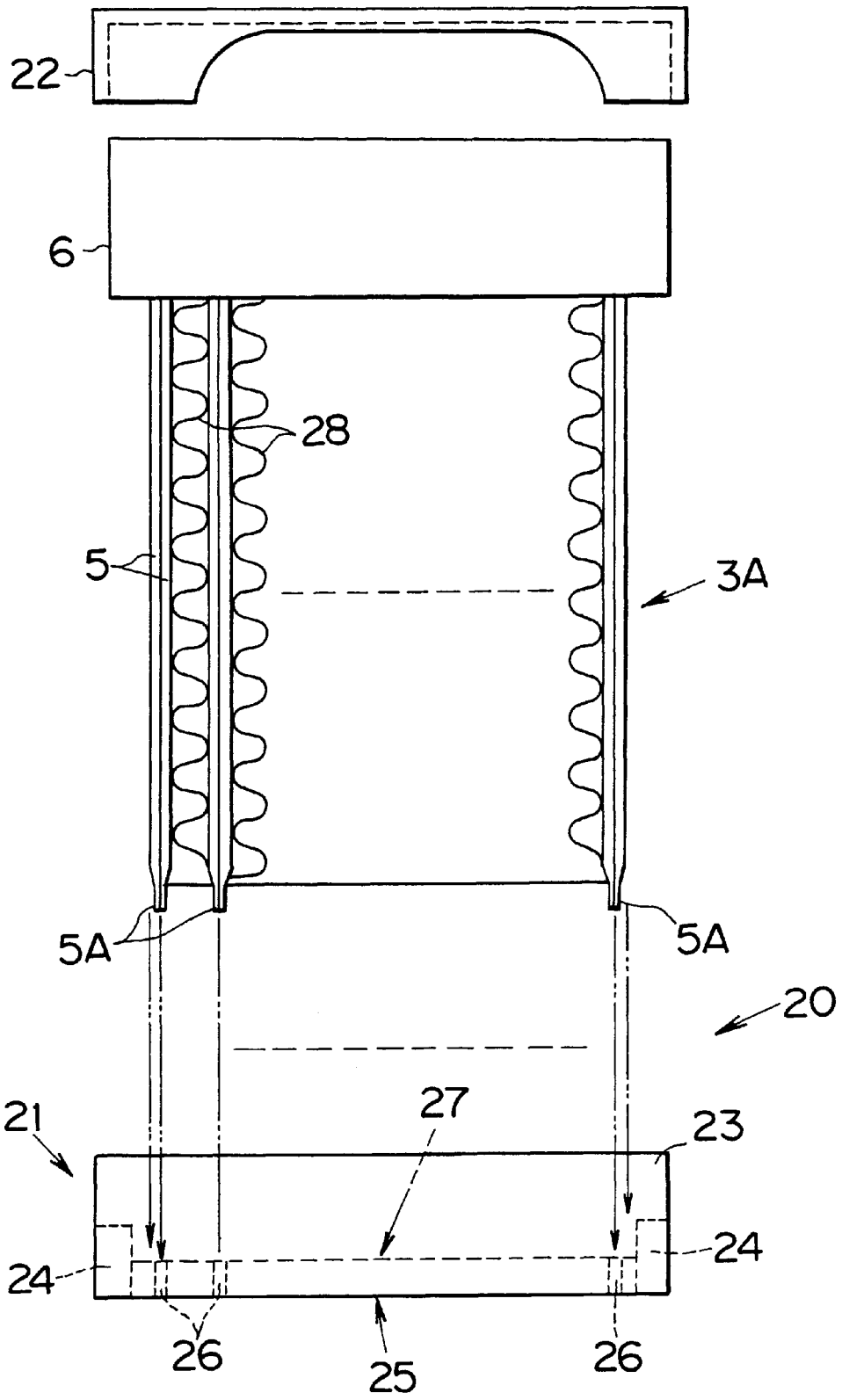
FIG. 2 is a front view of the same.

FIGS. 1 and 2 are a side view and a front view of the mounting structure 20. The heating core mounting structure 20 includes a plate-side spacer 21 at the bottom of the heater core 3A and a tank-side spacer 22 at the top of the heater core 3A.

The width T of the plate-side spacer 21 is the same as the width T of the heater core 3 shown in tank 6. The plate-side spacer 21 can therefore be mounted in the heater case 2 by insertion.

Figure 3:
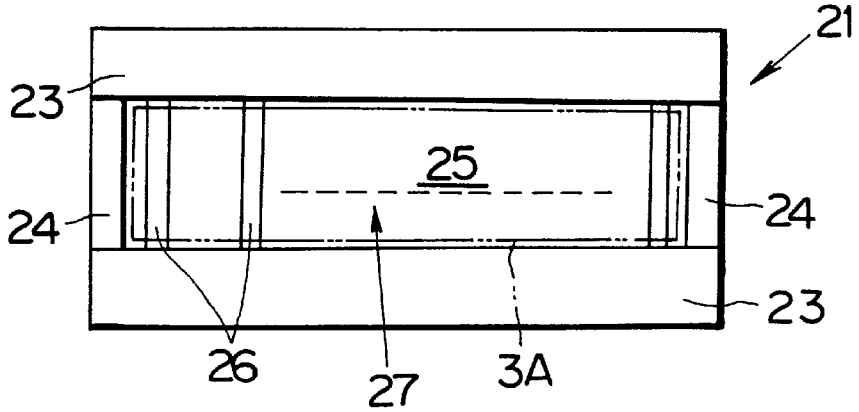
FIG. 3 is a plan view of a plate-side spacer 21.

FIG. 3 is a plan view of the plate-side spacer 21. As shown in FIGS. 1 to 3, the plate-side spacer 21 has a pair of main fixing portions 23 extending in parallel at a spacing equal to the width T of the heater core 3, a pair of auxiliary fixing portions 24 extending between the opposite lateral ends of the main fixing portions 23, and a floor portion 25 enclosed by the main fixing portions 23 and the auxiliary fixing portions 24.

The floor portion 25 is formed with slits 26 (engagement portions) in the same number and pitch as the end portions 5A of the stacked plates 5. The slits 26 pass completely through the floor portion 25.

The portion enclosed by the main fixing portions 23, the auxiliary fixing portions 24 and the floor portion 25 constitutes a mounting portion 27 for the end of the stacked plates 5 having the stacked end portions 5A.

Reference numeral 28 in FIG. 2 designates corrugated fins.

The tank-side spacer 22 is for mounting the tank 6. Like the plate-side spacer 21, it has the width T of the heater core 3 and can also be mounted in the heater case 2 by insertion.

As shown in FIG. 1 and 2, the mounting of the heater core 3A by the mounting structure 20 is achieved by inserting the end of the stacked plates 5 having the end portions 5A into the mounting portion 27 of the plate-side spacer 21 and engaging the end portions 5A with the slits 26. The heater core 3A and the plate-side spacer 21 can therefore be readily and integrally positioned at the prescribed location.

The tank-side spacer 22 is similarly fitted on the tank 6 end, whereafter the heater core 3A fitted with the plate-side spacer 21 and the tank-side spacer 22 is mounted in the heater case 2.

Since the heater core is mounted in the heater case 2 via the plate-side spacer 21 and the tank-side spacer 22, a heater core 3 of a different thickness from the heater core 3A can be similarly mounted without need to modify the heater case 2.

Since the engagement of the stacked end portions 5A with the slits 26 can be checked at the underside of the slits 26, the inspection of the engagement and the positioning work can be conducted with ease.

In the fitted state of the heater core 3A and the plate-side spacer 21, the stacked end portions 5A engage with the slits 26 and the opposite ends of the heater core 3A in its stacked direction are restrained by the auxiliary fixing portions 24. The heater core 3A can therefore be kept solidly fixed to the plate-side spacer 21 without risk of deforming or damaging the stacked end portions.

As indicated by the chain lines in FIG. 1, the lateral length of the main fixing portions 23, i.e., the left-to-right length in the direction of air flow, can be changed so as to shift the mounting portion 27 in the downstream direction (to the right in the drawing) and thus position the heater core 3A closer to the aforementioned air-mixing chamber 13. By this, the volume of the air-mixing chamber 13 can be kept the same irrespective of whether the mounted heater core is the thicker heater core 3 or the thinner heater core 3A. The air-mixing performance within the air-mixing chamber 13 can therefore be maintained unchanged irrespective of heater core thickness.

Such shifting of the heater core position is of course possible in either the upstream or downstream direction, simply by selecting appropriate spacers. The volume of the air-mixing chamber 13 can therefore be maintained or changed to appropriately maintain or adjust the air-mixing performance independently of change in heater core thickness.

The shape and number of the slits formed in the plate-side spacer can be determined as desired.

Figure 4:
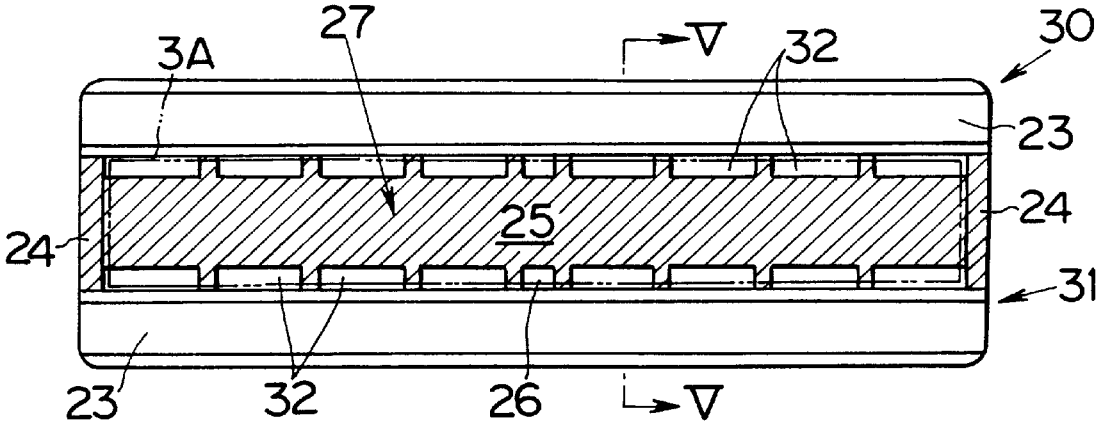
FIG. 4 is a plan view of a plate-side spacer 31 of a mounting structure 30 for mounting a heater core 3A, which is a second embodiment of the invention.
Figure 5:
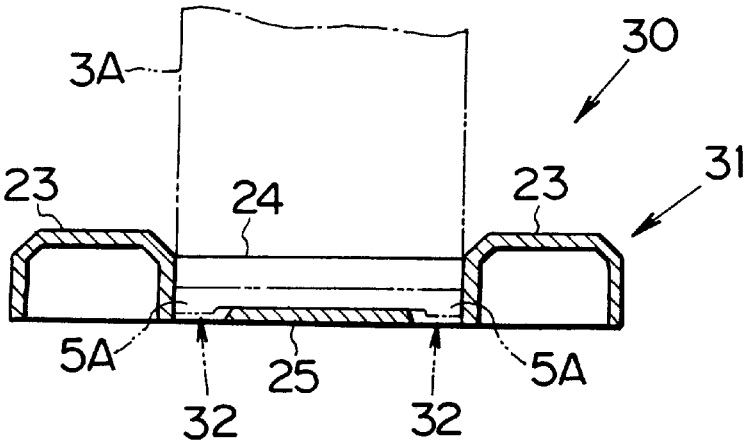
FIG. 5 is a sectional view taken along line V—V in FIG. 4.

This is clear, for example, from the mounting structure 30 for the heater core 3A according to a second embodiment of the invention, whose plate-side spacer 31 is shown in a plan view in FIG. 4 and in a sectional view in FIG. 5 taken along line V—V in FIG. 4.

As illustrated, the floor portion 25 of the plate-side spacer 31 is formed with two rows of slits each having a plurality of slits 32 (engagement portions) and a single slit 26. Each slit 32 can engage two stacked end portions 5A. In other respects, the structure is essentially identical with that of the plate-side spacer 21.

When the plate-side spacer 31 of this configuration is used, the heater core 3A can be mounted in the heater case 2 in the same way as when using the heating core mounting structure 20 (FIG. 1) having the plate-side spacer 21, by engaging the end portions 5A of the stacked plates 5 with the slits 32 and the slits 26.

In the second embodiment, the center portion of the floor portion 25 between the two rows of slits 32 and slits 26 remains solid (unslitted) and the number of slits 32 is smaller than the number of slits 26 in the first embodiment. The plate-side spacer 31 can therefore be fabricated to maintain its strength within a desired range.

As explained in the foregoing, one of the two spacers of the heater core mounting structure according to the invention is formed with slits or other engagement portions for engagement with the stacked end portions of the stacked plates. Heater cores of different thickness can therefore be mounted without modifying the heater case by selecting the positional relationship between the heater core and the spacer. The invention therefore improves the efficiency of the mounting work, minimizes cost and enables maintenance/adjustment of air mix performance.

What is claimed is:

1. A heater core mounting structure for mounting a stacked-plate heater core in a heater case of a heater unit, the heater core mounting structure comprising:

a spacer by which the heater core is mounted in the heater case, the spacer being of greater width than the heater core and the spacer being provided with engagement portions configured to engage stacked end portions of the heater core.

2. A heating core mounting structure according to claim 1, wherein the stacked-plate heater core is constituted of a stack of multiple stacked plates and the stacked end portions are present as a large number of thin projections sticking out slightly from main bodies of the stacked plates.

3. A heating core mounting structure according to claim 1, wherein the spacer has main fixing portions disposed to face each other in a direction of heater core thickness, auxiliary fixing portions disposed to face each other in a stacked direction of the heater core, and a floor portion enclosed by the main fixing portions and the auxiliary fixing portions and provided with the engagement portions.

4. A heating core mounting structure according to claim 3, wherein a portion enclosed by the main fixing portions, the auxiliary fixing portions and the floor portion constitutes a mounting portion for an end of stacked plates having the stacked end portions.

5. A heating core mounting structure according to claim 1, wherein the heater case is manufactured to conform with a heater core of large thickness and a heater core of smaller thickness is mounted in the heater case via the spacer.

6. A heating core mounting structure according to claim 1, wherein relative position between the spacer and the heater core engaged with the spacer is adjustable in a direction of an air flow.

7. A heating core mounting structure according to claim 1, wherein:

the heater core has a tank at its upper end portion and the stacked end portions at an opposite lower end portion and the spacer is a plate-side spacer and further comprising a tank-side spacer for mounting the tank, the heater core being mounted in the heater case at its upper end portion via the tank-side spacer and at its lower end portion via the plate-side spacer.

8. A heating core mounting structure according to claim 1, wherein the engagement portions are formed in a single row.

9. A heating core mounting structure according to claim 1, wherein the engagement portions are formed in two rows.

10. A heating core mounting structure according to claim 1, wherein the engagement portions each engage one stacked end portion.

11. A heating core mounting structure according to claim 1, wherein the engagement portions each engage at least two stacked end portions.

12. A heating core mounting structure according to claim 1, wherein:

the engagement portions are formed in two rows, the spacer has main fixing portions disposed to face each other in a direction of heater core thickness, auxiliary fixing portions disposed to face each other in a stacked direction of the heater core, and a floor portion enclosed by the main fixing portions and the auxiliary fixing portions and provided with the engagement portions, and a center portion of the floor portion between the two rows of slits remains unslitted.

13. A heating core mounting structure according to claim 1, wherein the engagement portions of the spacer are a plurality of slits.

* * * * *